US005601009A

United States Patent [19]

Jepsen et al.

[11] Patent Number: 5,601,009

[45] Date of Patent: Feb. 11, 1997

[54] HYDRAULIC MACHINE AND METHOD FOR ASSEMBLING A PISTON AND SLIDER SHOE UNIT

[75] Inventors: Hardy P. Jepsen; Ove T. Hansen, both of Nordborg, Denmark

[73] Assignee: Danfoss A/S, Nordborg, Denmark

[21] Appl. No.: 446,679

[22] PCT Filed: Dec. 23, 1993

[86] PCT No.: PCT/DK93/00443

§ 371 Date: May 31, 1995

§ 102(e) Date: May 31, 1995

[87] PCT Pub. No.: WO94/16217

PCT Pub. Date: Jul. 21, 1994

[30] Foreign Application Priority Data

Jan. 18, 1993 [DE] Germany ..... 43 01 123.3

[51] Int. Cl.[6] ..... F01B 3/00

[52] U.S. Cl. ..... 92/71; 92/187; 417/269; 74/60

[58] Field of Search ..... 92/12.2, 71, 57, 92/187, 128; 91/499; 417/269; 74/60

[56] References Cited

U.S. PATENT DOCUMENTS 3,183,848 5/1965 Raymond ..... 74/60

3,261,216 7/1966 Woolfenden ..... 74/60

4,617,856 10/1986 Miller et al. ..... 417/269

FOREIGN PATENT DOCUMENTS 62-41980 2/1987 Japan ..... 417/269

*Primary Examiner*—Thomas E. Denion

*Attorney, Agent, or Firm*—Lee, Mann, Smith, McWilliams, Sweeney & Ohlson

[57] ABSTRACT

A hydraulic machine with a piston and slider shoe unit (1) is disclosed, in which the piston (2) and the slider shoe (3) are joined to one another by way of a ball-and-socket joint (4) forming a first contact surface, and the slider shoe (3) lies via the intermediary of a second contact surface on a control surface (9), a friction-reducing layer being arranged on one contact surface. It is desirable for a hydraulic machine of the that kind to be capable of reliable operation even when using hydraulic fluids having only a operation even when using hydraulic fluids having only a poor or no lubricating effect at all, yet to be inexpensive to manufacture. For that purpose, the friction-reducing layer (11) is extended to at least one further contact surface.

16 Claims, 1 Drawing Sheet

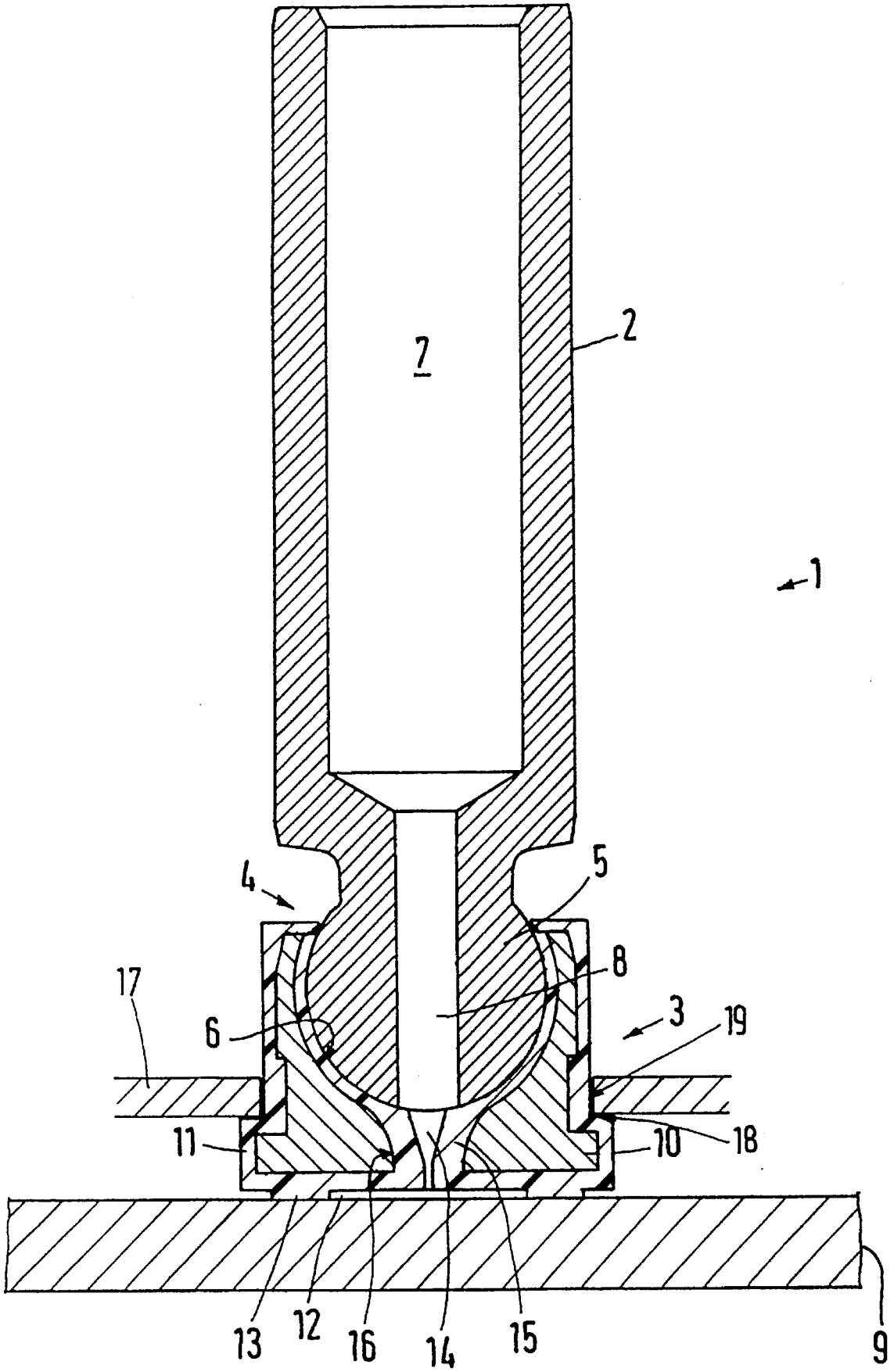
7
2
1
4
5
8
17
6
3
19
11
10
18
13
12
16
14
15
9

HYDRAULIC MACHINE AND METHOD FOR ASSEMBLING A PISTON AND SLIDER SHOE UNIT

BACKGROUND OF THE INVENTION

The invention relates to a hydraulic machine with a piston and slider shoe unit, in which the piston and the slider shoe are joined to one another by way of a ball-and-socket joint forming a first contact surface, and the slider shoe lies via the intermediary of a second contact surface on a control surface, a friction-reducing layer being arranged on one contact surface.

A hydraulic machine of that kind can operate according to the axial piston principle or according to the radial piston principle. In both cases the movement of the piston is controlled by way of a control surface on which the slider shoe lies and over of which it is guided during movement of the rail. When the control surface is inclined, the angular position of the slider shoe with respect to the piston changes during operation, as is the case, for example, with an axial piston machine having an inclined wobble plate.

In a known hydraulic machine (DE-OS 21 18 712) various principles are known to fix the slider shoe to the piston by means of a ball-and-socket joint. For that purpose, the ball and the slider shoe are interlockingly engaged with one another by means of a joining element; measures are taken to ensure that the ball of the ball-and-socket joint is mounted in the slider shoe so that the required rotary movement between the slider shoe and the piston is possible. US 3 183 848 describes a pump operating according to the axial piston principle, in which the slider shoes are made of nylon and are secured to the ball of the ball-and-socket joint by means of a metal clip.

During operation of the machine, friction occurs between the slider shoe and the control surface and between the slider shoe and the piston in the ball-and-socket joint, through the movement of the respective parts relative to one another. So that wear and tear and friction loss do not become too great, the contact surfaces are therefore lubricated. The hydraulic fluid that is already present is used for lubrication here. As a consequence, however, the choice of hydraulic fluids is restricted to those liquids that have a satisfactory lubrication. These are essentially synthetic oils, which are being regarded with ever increasing disfavour in the expanding debate on environmental protection now in progress. Replacing these oils by other liquids is possible only to a limited extent, since, as already mentioned, lubrication is not ensured in all cases.

In a machine of the kind mentioned in the introduction (JP 2-125 979 A), it is known to provide a friction-reducing layer comprising a plastics material mixed with fibres between the slider shoe and the control surface.

Fixing a plastics material of that kind to the slider shoe is, however, relatively complicated. The surface to be provided with the layer needs to be roughened or grooved, and the friction-reducing layer is then supposed to be adhesively secured to that surface. Because the adhesive bond is stressed primarily by shearing forces, there is a risk that the bond will not hold for long and the friction-reducing layer will therefore become detached, which leads to damage to the machine. With the known machine there furthermore the danger that too much friction will develop in the ball-and-socket joint, which can ultimately lead to this joint seizing up or binding. This would also result in damage to the machine.

SUMMARY OF THE INVENTION

It is therefore the aim of the present invention to provide a hydraulic machine which can be operated reliably even when using hydraulic fluids of lesser lubricity and which can be manufactured inexpensively.

This aim is achieved in a hydraulic machine of the kind mentioned in the introduction in that the friction-reducing layer is extended to at least one further contact surface.

The friction-reducing layer on the surfaces which form the contact surfaces now forms functionally a separate machine element which carries out the function of "lubrication", previously performed by the hydraulic fluid. If the material of which the friction-reducing layer is made is correctly matched to the material of the part to be moved relative to it, coefficients of friction that are altogether comparable with coefficients of friction of a liquid-lubricated contact surface can be achieved. Since it is a question only of one layer, with the remaining construction of the piston and slider shoe unit remaining substantially unchanged, there are also no problems with stability or strength, in particular at high temperatures, such as problems that may occur when the slider shoe is replaced by a plastics material part. Extending the friction-reducing layer beyond a contact surface to a further contact surface has the advantage that the layer can now no longer be planar, but can go in any manner into the third dimension in order to safeguard the relationship between several contact surfaces. In a construction of that kind, however, there are inevitably parts or portions of the layer that are directed at right angles to the forces occurring and which layer can therefore be held fixedly on the slider shoe with relatively great reliability. The forces can here be substantially absorbed by the interlocking engagement of the layer with the slider shoe. Stress on adhesive joints is therefore correspondingly weaker.

A third contact surface is preferably provided between a pressure plate and the slider shoe, and the friction-reducing layer is extended to all three contact surfaces. The relative movement between the pressure plate and the slider shoe is only relatively small, but it is not entirely negligible. Here too, the friction caused by this relative movement is quite dramatically reduced as a result of extending the friction-reducing layer. In addition, extending the friction-reducing layer to the third contact surface has the advantage that the layer can be held on the slider shoe even better.

The friction-reducing layer is preferably formed by a plastics material part. This plastics material part can be incorporated with the piston and slider shoe unit as this is being assembled. Very low coefficients of friction can be achieved with plastics materials. Examples of plastics materials which may be considered for the part include materials from the group of high-strength thermoplastic plastic materials based on polyaryl ether ketones, in particular polyether ether ketones, polyamides, polyacetals, polyaryl ethers, polyethylene terephthalates, polyphenylene sulphides, polysulphones, polyether sulphones, polyether imides, polyamide imide, polyacrylates, phenol resins, such as novolak resins, or similar substances, glass, graphite, polytetrafluoroethylene or carbon, especially in fibre form, being used as fillers. When using such materials, it is likewise possible to use water as the hydraulic fluid.

In this connection, it is especially preferable for the plastics material part to be in the form of a moulded part, especially an injection-moulded part. Moulding, in particular injection-moulding of the plastics material part, affords several advantages simultaneously. Firstly, the friction-reducing layer is created in a simple manner by the moulding.

Secondly, tolerances in the dimensions can be increased. Inconsistencies are then back-filled by the plastics material layer during moulding. Only in the area around the ball-and-socket joint is it important to guarantee that the ball and the recess of the slider shoe receiving the ball retain their essentially spherical shape. A further reduction in manufacturing costs can therefore be achieved as a result.

Surface structures are preferably provided in the friction-reducing layer. Such surface structures serve to relieve the hydrostatic pressure, in particular in the area of contact between the slider shoe and the control surface. Such surface structures, which can be in the form of channels or pockets, for example, are also able to equalize forces, so that the stability of the slider shoe is improved. Previously, these surface structures had to be worked in the corresponding surface of the slider shoe, which generally necessitated a machining operation. The formation of the surface structures in the layer makes that work step redundant. The structures can be incorporated as the layer is being produced, in particular if the layer is moulded or injection-moulded.

The friction-reducing layer is preferably fixed to the slider shoe. The friction-reducing layer therefore performs all the movements of the slider shoe. Regardless of the position of the slider shoe, friction reduction is therefore always ensured.

The friction-reducing layer is advantageously of integral construction with a holding member which is arranged in a bore running substantially at right angles to the respective contact surface. The holding member safeguards the friction-reducing layer against being displaced on the slider shoe. For such a displacement to occur, forces that have at least one component substantially parallel to the particular contact surface would be necessary. If the holding member extends at right angles to the contact surface, the forces running parallel to the contact surface are absorbed by the holding member.

It is especially advantageous for a respective friction-reducing layer to be provided on both contact surfaces, and for both layers to be joined to one another by the holding member. All friction-reducing layers are therefore of integral construction. This simplifies manufacture. The friction-reducing layer can be produced in a single manufacturing step. No detrimental transitions can be created afterwards which would cancel out the advantageous effect of the friction reduction.

The holding member preferably has a continuous opening which is connected to a continuous bore provided in the piston. Hydraulic fluid is able to flow through the continuous bore out of the piston, through the continuous opening, to the contact surface between the slider shoe and control surface and there relieve hydrostatic pressure. Even if the hydraulic fluid has ceased its lubricating function or is no longer lubricating satisfactorily, this measure nevertheless causes a further reduction in friction.

It is especially advantageous for the friction-reducing layer to surround the slider shoe closely at least in the pressure region. This prevents the hydraulic fluid under pressure from penetrating between the layer and the slider shoe and destroying the cohesion between the slider shoe and the friction-reducing layer. A simple wetting with pressure-less hydraulic fluid in regions in which the slider shoe is not completely enclosed by the friction-reducing layer is harmless.

Advantageously, the slider shoe comprises a body with a recess, the opening of which has a width that is at least the same as the diameter of the ball contained in the ball-and-socket joint. This facilitates manufacture of a piston and slider shoe unit quite considerably. The ball can then be mounted in the recess without difficulty and without further shaping work. The ball is then held later by the plastics material part which may reduce the width of the opening far enough so that the ball can no longer be removed from the recess.

In this connection, it is preferable for the recess to have a shape other than a ball-like shape. This also simplifies manufacture. When making the recess, greater tolerances can be allowed. The spherical sliding-contact face, which co-operates with the ball of the ball-and-socket joint, is then provided by the plastics material part, that is, the friction-reducing layer. In addition, this feature ensures that the ball moves relative to the friction-reducing layer and the friction-reducing layer remains stationary in the recess.

The invention also relates to a method for assembling a piston and slider shoe unit such as that described above, in which an injection-moulded part of plastics material is made and is fixed to the slider shoe.

The injection-moulded part forms the friction-reducing layer. A suitable combination of plastics material and the material of the control surface and the material of the ball of the ball-and-socket joint enables very satisfactory coefficients of friction to be achieved.

In this connection, it is especially preferable for the injection-moulded part to be produced in situ, after the piston and the slider shoe have been mutually positioned. Each injection-moulded part is therefore adapted to the individual piston and slider shoe unit. Manufacturing tolerances can in this manner largely be compensated for. If desired, the assembly of ball and slider shoe can also be simplified in that the opening of the spherical recess in the slider shoe, which receives the ball of the ball-and-socket joint, is large enough for the ball to pass through with its largest diameter. Once the ball has been inserted into the spherical recess, the plastics material is then injected, so that the ball is surrounded to such an extent that it is no longer able to slip out of the recess of its own accord.

The plastics material is preferably conveyed through the slider shoe to at least one contact surface. This procedure has the advantage that a defined path is formed for the injection-moulded plastics material. For that purpose, all that is required is a continuous bore in the slider shoe. A corresponding negative form is introduced through the piston which ensures that a fluid path through the slider shoe, which later allows hydrostatic lubrication of the sliding-contact face between the slider shoe and the control surface, is formed. If desired, after moulding a part of the base surface is removed by turning in order to open this continuous bore. This step enables the outlet diameter of the bore to be determined relatively accurately.

Advantageously, the piston and the slider shoe are together clamped in a holding tool before the injection-moulding operation. This enables the gap between the ball of the ball-and-socket joint fixed to the piston and the slider shoe to be set relatively accurately so that it is substantially the same width throughout. The injection-moulded part is then substantially everywhere uniformly stressed in the region of the first contact surface. This makes for a long service life. In addition, it simplifies manufacture. The piston and slider shoe unit remains in the tool until the plastics material has hardened.

The holding tool preferably defines the external form of the slider shoe. By means of the holding tool, the desired surface structures can consequently be produced during the injection-moulding as well.

BRIEF DESCRIPTION OF THE DRAWING

The invention is explained hereinafter with reference to a preferred embodiment and in conjunction with the drawing. The single Figure shows a piston and slider shoe unit.

DESCRIPTION OF THE PREFERRED EMBODIMENT

A piston and slider shoe unit 1 comprises a piston 2 and a slider shoe 3 which are rotatably connected to one another by way of a ball-and-socket joint 4. The ball-and-socket joint 4 has for that purpose a ball 5 secured to the piston 2 and a spherical recess 6 provided in the slider shoe 3.

In a manner known per se, the piston 2 has a hollow space 7 inside it which is connected to a continuous bore 8 passing through the ball 5.

The slider shoe 3 slides on a control surface 9 which, in a hydraulic machine of the axial piston type, can be formed, for example, by the sliding-contact face of a wobble plate.

Of course, the ball 5 can also be provided on the slider shoe and the recess 6 can also be provided on the piston.

The slider shoe 3 comprises a body 10 which is completely enclosed by a plastics material layer 11. In many cases it will also be sufficient for the plastics material layer 11 on the radial outer side the body 10 to be provided only over a part of the axial length. In that case, it should be ensured that the layer 11 is long enough to extend beyond the thickness of a clamping washer 17, that is, reduces the friction between the clamping washer 17 and the body 10 in a region which is formed by the surfaces 18, 19. The plastics material layer 11 has surface structures, namely recesses 12 and projections 13, on its side facing the control surface 9. The recesses form channels and pockets which are connected by way of a continuous opening 14 to the continuous bore 8 in the ball 5. The continuous opening 14 widens somewhat conically at its end 5 facing the ball, so that the connection between the continuous bore 8 and the continuous opening 14 is also ensured when the slider shoe 3 is inclined with respect to the piston 2. The widening can also be of a different shape provided that hydraulic fluid is able to reach the sliding-contact face even when the slider shoe is inclined.

The plastics material layer 11 also fills up an intermediate space between the slider shoe body 10 and the ball 5. Here, it forms a first contact surface, or a first region of contact, with the slider shoe 3. In the region of the control surface 9, the plastics material layer 11 forms a second contact surface or a contact region. The plastics material layer 11 encloses the slider shoe body 10 completely here, that is, even in the region of a bore 16 which is positioned substantially at right angles to the surfaces of contact. In this bore 16, the plastics material layer 11 forms a holding part 15, which is able to absorb forces directed parallel to the contact surfaces, consequently holds the plastics material layer 11 securely in place and protects it against displacement. A third contact surface is formed facing the clamping washer 17.

By matching the plastics material of the plastics material layer 11 to the material of the ball 5 and of the control surface 9, coefficients of friction at the first and at the second contact surface which are entirely comparable with those of a fluid-lubricated contact surface can be achieved. When using a plastics material layer 11 of this kind, lubrication by means of the hydraulic fluid can therefore be dispensed with.

The plastics material layer 11 is produced by injection-moulding. For that purpose, the piston 2 and the slider shoe 3 are together held in a holding tool. The holding tool defines the position of piston 2 and slider shoe 3 relative to one another so that the desired gap between the slider shoe body 10 and the ball 5 is created. At the same time, the holding tool surrounds the slider shoe body 10 spaced from the outside thereof. The base of the holding tool is provided with a negative shape for the surface structures 12, 13. A negative form is introduced into the piston 2 of the piston and slider shoe combination held in this way through the cavity 7, and keeps a part of the continuous opening 14 clear. A plastics material is then injected from the other side of the slider shoe 3. The plastics material spreads out, its spread being restricted by the slider shoe body 10, the ball 5 and the holding tool, which is not shown more precisely. The injection-moulded plastics material is therefore able to penetrate into the gap between the slider shoe body 10 and the ball 5 without difficulty. At the upper end it then combines with a part of the plastics material which has flowed externally around the slider shoe body 10. That enables the slider shoe body to be completely sheathed. Subsequent mechanical machining is not necessary because the surface structure 12, 13 in the second contact surface has already been formed during the moulding operation. If the negative form keeping the continuous opening 14 clear has not filled up the entire length of the continuous opening 14, a part of the underside of the slider shoe 3 may optionally have to be turned off on a lathe.

A piston and slider shoe unit 1 of that kind can also operate with hydraulic fluids that have no lubricating effect. The contact stress between contacting parts is absorbed exclusively by the plastics material layer 11. Two metal parts, for example, could not be used, because they would rub too harshly against one another without lubrication. In the past, metal parts were therefore used with nonadhering bearing materials between the friction surfaces. At low pressures, such constructions can indeed be used, but at high pressures there is a danger that the hydraulic fluid will get into the gaps between the bearing material and the metal parts which leads on the one hand to increased leakage and on the other hand to destruction of the bearing material itself because this can tear, for example. Such effects are avoided with the friction-reducing layer described.

We claim:

1. A hydraulic machine having a piston and slider shoe in a unit, in which the piston and the slider shoe are joined to one another by way of a ball-and-socket joint having a ball formed on one of said piston and slider shoe and a socket formed in the other of said piston and slider shoe, a first contact surface located between said ball and said socket, the slider shoe lying on a control surface, a second contact surface being located between said slider shoe and said control surface, a friction-reducing layer being arranged on said first contact surface, and the friction-reducing layer being extended to at least said second contact surface.

2. A machine according to claim 1, in which a third contact surface is located between a pressure plate and the slider shoe, and the friction-reducing layer is extended to all three contact surfaces.

3. A machine according to claim 1 in which the friction-reducing layer is formed by a plastic material part.

4. A machine according to claim 3, in which the plastic material part is in the form of an injection-moulded part.

5. A machine according to claim 1, in which surface structures are provided in the friction-reducing layer.

6. A machine according to claim 1, in which the friction-reducing layer is fixed to the slider shoe.

7. A machine according to claim 6, in which the friction-reducing layer is of integral construction with a holding member which is arranged in a bore running substantially at right angles to one of said contact surfaces.

8. A machine according to claim 7, in which respective friction-reducing layer is provided on two contact both friction-reducing layers are joined to one another by the holding member.

9. A machine according to claim 8, in which the holding member has a continuous opening which is connected to a continuous bore provided in the piston.

10. A machine according to claim 1, in which the friction-reducing layer surrounds the slider shoe closely at least in a pressure region.

11. A machine according to claim 1, in which the slider shoe comprises a body with a recess, the opening of which has a width that is at least the same as the diameter of the ball contained in the ball-and-socket joint.

12. A method for assembling a piston and slider shoe unit described in claim 1, in which an injection-moulded friction-reducing layer part of plastic material is made and is fixed to the slider shoe.

13. A method according to claim 12, in which the layer part is produced in situ, after the piston and the slider shoe have been assembled.

14. A method according to claim 13, in which the plastic material is conveyed through the slider shoe to at least one contact surface.

15. A method according to claim 13, in which the piston and the slider shoe are together clamped in a holding tool before the injection moulding operation.

16. A method according to claim 15, in which the holding tool defines an external form of the slider shoe.

* * * * *